US006971310B1

(12) United States Patent
Christiansen

(10) Patent No.: US 6,971,310 B1
(45) Date of Patent: Dec. 6, 2005

(54) METHOD OF OPERATION OF A PRINTING UNIT AND PRINTING UNIT FOR OFFSET MACHINE

(75) Inventor: Henrik Christiansen, Hellerup (DK)

(73) Assignee: Tresu Production A/S, Bjert (DK)

( * ) Notice: Subject to any disclaimer, the term of this patent is extended or adjusted under 35 U.S.C. 154(b) by 0 days.

(21) Appl. No.: 10/089,456

(22) PCT Filed: Sep. 29, 2000

(86) PCT No.: PCT/DK00/00542

§ 371 (c)(1),
(2), (4) Date: May 24, 2002

(87) PCT Pub. No.: WO01/25010

PCT Pub. Date: Apr. 12, 2001

(30) Foreign Application Priority Data

Oct. 1, 1999 (DK) ..... 1999 01408

(51) Int. Cl.[7] ..... B41F 31/00
(52) U.S. Cl. ..... 101/350.6; 101/147
(58) Field of Search ..... 101/217, 147, 101/148, 350.6, 137, 177, 424.2, 485, 450.1, 101/351.1, 352.01, 351.3, 247, 352.04; 118/46

(56) References Cited

U.S. PATENT DOCUMENTS 4,421,027 A * 12/1983 Fischer ..... 101/142
4,567,823 A 2/1986 Hummel et al.
4,722,273 A 2/1988 Jahn
4,741,269 A * 5/1988 Aylor et al. ..... 101/148
4,796,556 A 1/1989 Bird
5,503,674 A 4/1996 Hofmann et al.
5,960,713 A 10/1999 DeMoore et al.

FOREIGN PATENT DOCUMENTS

| | | |
|---|---|---|
| DE | 3500437 | 10/1985 |
| DE | 3941571 | 6/1990 |
| DE | 19729985 | 1/1999 |
| EP | 0574124 | 12/1993 |
| EP | 0767058 | 4/1997 |
| GB | 1138055 | 12/1968 |
| GB | 2119711 | 11/1983 |
| GB | 2184982 | 7/1987 |
| GB | 2327196 | 1/1999 |
| GB | 2327205 | 1/1999 |
| JP | 59 209875 | 11/1985 |
| WO | WO 99/01282 | 1/1999 |

* cited by examiner

*Primary Examiner*—Andrew H. Hirshfeld
*Assistant Examiner*—Leo T. Hinze
(74) *Attorney, Agent, or Firm*—James Creighton Wray; Meera P. Narasimhan

(57) ABSTRACT

There is described a printing unit (1) for use in an offset machine. The printing unit enables wider application of offset machines (1). This is achieved by the coating means and the water application means comprising a unit (28) consisting of a doctor blade (30) and at least one roller (29, 32) for transferring coating or water from the doctor blade (30) to the plate cylinder (15)/blanket cylinder (14) of the printing unit. The unit (28) is arranged for pivoting so that water is transferred to plate cylinder, and coating is transferred directly to the blanket cylinder.

9 Claims, 5 Drawing Sheets

PRIOR ART

METHOD OF OPERATION OF A PRINTING UNIT AND PRINTING UNIT FOR OFFSET MACHINE

This application claims the benefit of Danish Application No. PA 1999 01408 filed Oct. 1, 1999 and PCT/DK00/00542 filed Sep. 29, 2000.

BACKGROUND OF THE INVENTION

The present invention concerns a method for operating a printing unit in which the printing unit comprises a doctor blade used for coating and as moistening unit for applying water, and where the coating means and the water application means are constituted by a unit comprising a doctor blade and at least one roller for transferring coating or water from the doctor blade.

Offset machines are well-known within the art and are therefore only described briefly. A web or a sheet on which printing is to be performed is led around back-pressure rollers or transfer rollers. The web or the sheets are brought into contact with a blanket cylinder for being applied the print to the applied in each single printing unit in the offset machine. The blanket cylinder is in contact with a plate cylinder transferring the colour print to be placed on the web. The plate cylinder is in contact with a moistening unit and a inking unit applying water and ink, respectively. Thus, an offset plate on the plate cylinder is rotated whereby water susceptible parts are moistened by the rollers of the moistening unit. Then the ink susceptible parts of the offset plate are supplied with ink from the ink rollers in the inking unit. The print image formed is then deposited on the blanket cylinder which further prints the ink on the web or the sheet. Preferentially, it will be a paper web but other materials may also be printed.

A printing unit according to the present invention may be used in a traditional offset machine, for example of the kind described in European patent application no 767,058. The content of this patent application is hereby incorporated by reference as the printing unit may be a part of an offset machine which is built up according to the same principle and with the same paper delivering and paper receiving means at the beginning and the finish of the printing unit as well as corresponding means for transferring paper web or single sheets between different printing units disposed in succession can be used for imparting the web the finished print. Also, the same kinds of printing ink may be used. Offset machines may be equipped with a coating unit. The coating unit will typically be constructed with a cylinder on which the coating is applied from a roller arrangement which is supplied from a vessel with clear coating.

In International patent application PCT/DK98/00303 there is described a system of the type mentioned in the introduction which is improved and thereby enables a broader application and more efficient operation of printing units in offset machines, where the printing unit may be used for coating and water application. In this system, the coating is established indirectly via the plate cylinder. However, it is desirable to apply coating directly on the blanket cylinder due to quality and finish in the formed print.

Furthermore, GB-A-2,119,711 discloses a stationary fountain comprising a doctor blade co-operating with a ductor. A lacquer roller is displaceable between a first position for transferring water via a plate cylinder and a second position for transferring coating directly to the blanket cylinder. There is no disclosure that the doctor blade could be displaced together with the interactive roller as a unit.

SUMMARY OF THE INVENTION

It is the object of the present invention to indicate a method for operating a printing unit and a printing unit for an offset machine which enables a wider use and a more efficient operation of printing units in existing and new offset machines. Furthermore, it is an object to indicate a moistening unit which simultaneously may be used for coating and which also enables flexoprinting in an offset machine.

According to the present invention this is achieved by a method which is peculiar in that the doctor blade and an interacting roller are displaced between a first position for transferring water via a plate cylinder to a blanket cylinder and a second position for transferring coating directly to the blanket cylinder.

The printing unit for use by the method is peculiar in that the coating and water application unit is arranged slidable between a first position for bringing said at least one roller in contact with a roller engaging the plate cylinder, and a second position for bringing said at least one roller in direct contact with the blanket cylinder of the printing unit.

The method and the apparatus make it possible that the doctor blade together with the roller form a unit which is slidable between the two positions.

By using such a method and such a unit it becomes possible to make offset machines so that they obtain wider application, and simultaneously the process may run more efficiently as the coat is not applied indirectly via the plate cylinder to the blanket cylinder. The slidable unit may be designed so that it may be retrofitted on existing offset machines.

Coating or water from the chamber is transferred to the blanket cylinder or the plate cylinder via a roller which preferably is a screen roller in the form of an Anilox roller, and the liquid lying in the cups of the screen roller is transferred to the blanket or plate cylinder. Transfer of water to the plate cylinder occurs as a rubber roller is inserted between the screen roller and the printing plate of the plate cylinder. Transfer of coating occurs directly to the blanket cylinder from the screen roller.

When the transfer unit is displaced to its second position for contact with the blanket roller, it is also possible to run flexographic printing. The blanket cylinder is provided with a printing plate, and the plate cylinder is displaced out of contact with the blanket cylinder. Then flexo inks may be transferred from the chamber and the transfer roller in the shape of an Anilox roller to the printing plate.

If a completely covering print is desired, a blanket may be used on the blanket cylinder as in the case of coating.

It will be possible to use separate doctor blades for inking/coating and water application. However, it will also be possible to use one and the same doctor blade for coating and water application.

In a coating unit, which typically is the last printing unit in an offset machine, it is advantageous that the coating means only comprise one screen roller in the form of an Anilox roller for transferring the coating which is applied directly form the doctor blade to the blanket cylinder.

Most machines will be provided with a frame with coupling means for supporting a cleaning system consisting of a liquid spray nozzle and cleaning paper. In some cases the printing unit according to the invention may be mounted in coupling means of this fame. Hereby, the need for special adaptation of the machine frame is avoided. Hereby it becomes particularly simple to modify an existing machine as the coupling means located in the frame of the offset machine are re-used as coupling means for the unit according to the invention.

The motor used for driving the screen roller is independent in order to adjust the rotational speed to different offset machines. Thus the unit does not need a special adaptation of the drive of the screen roller for different offset machines. In the machine, there will only be need for a suspension which in its most simple form consists of four pegs or screws on a rack.

By using a unit according to the invention, which is based on a doctor blade, it will be possible to apply highly pigmented inks, as for example metal enamels. This will not be possible with common offset printing units as pigments/inks will clog here and make impossible the formation of a quality print.

The unit according to the invention may also be use as a moistening unit. In the known moistening units, an environmental problem arises. In order to transfer the moistening water with the present roller arrangement, it is necessary to add solvents. At the moment, this has been prohibited at several places.

Alternatively, it has been attempted to solve the problem by teflon coating for forming a kind of mask with the purpose of avoiding ink depositing in certain areas. This is known as dry offset and is a different process in principle. Thus teflon has been used for substituting the water application from the moistening rollers. This system has an advantage as the paper is not moistened and thereby the risk that coating adheres badly do not arise.

Instead of using the traditional moistening units, there may be used a system which comprises a doctor blade and a screen roller and a rubber roller between the doctor blade and the plate cylinder as described in the above International patent application. This is advantageous as faster operation than previously is feasible. The amount of water or water sausage formed in a wedge-shaped interspace between the rubber roller and the plate cylinder may be varied by running with varied speed between the rubber roller and the plate cylinder. By running the rubber roller with greater speed it is thus possible to provide a greater amount of water in the wedge. The amount of water may also be adjusted by varying the slot width occurring between the rubber roller and the plate cylinder. The printing unit according to the invention is thus advantageous in that the amount of water situated in the slot may be varied according to need.

As printing unit may be intended for coating and as moistening unit, it will be possible to use the same unit consisting of a doctor blade and transfer roller for both water and coating.

By using a common moistening unit it will not be possible to apply coating. Due to the surface speeds, a great and unallowable contamination of the surroundings will occur as coating will be sprayed from the periphery of the roller and from the ends of the rollers. By using the unit according to the invention for coating, it will be possible to avoid contamination.

It is also possible that, together with a plate cylinder and a blanket cylinder, there may be provided two units according to the invention of which one unit is used for coating and the other for water application. Hereby it becomes possible to provide stripes of coating and stripes of ink side by side on the plate cylinder. This is made possible as the doctor blade may be divided up for giving off liquid/ink over a part of their length. Hereby is thus achieved the possibility of making print with quite new effects.

BRIEF DESCRIPTION OF THE DRAWINGS

In the following, the invention will now be explained with reference to the accompanying schematic drawing, where.

DETAILED DESCRIPTION OF THE PREFERRED EMBODIMENTS

Figure 1:
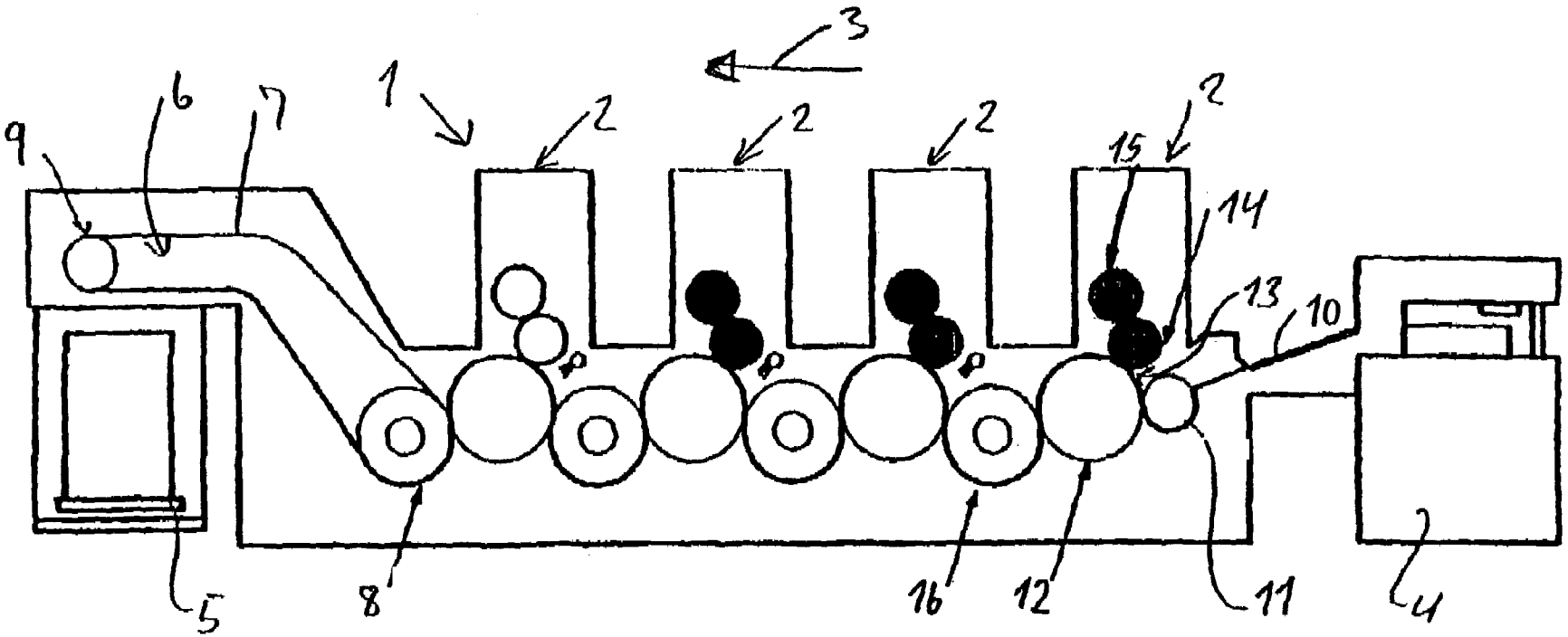
FIG. 1 PRIOR ART
FIG. 1 shows a side view of a typical offset machine comprising four printing units.

FIG. 1 shows a traditional offset printing machine 1 comprising four printing units 2. The machine has a transport direction 3 for sheets that are printed. The sheets comes from a delivery station 4 and are conveyed to a receiving station 5 by means of a delivery arrangement 6 comprising a conveyor belt 7. The conveyor belt 7 runs about two chain wheels 8,9. The single sheets are conveyed from the unit 4 via a path 10 around an impression cylinder or back-pressure cylinder 12. The single sheets are placed at a position indicated by 13. The sheets are thus placed in an area between a blanket cylinder 14 and the impression cylinder 12. The blanket cylinder 14 is in contact with a plate cylinder 15. Besides the impression cylinder 12, the offset machine also comprises transfer cylinders 16 for the sheets.

The offset machine furthermore comprises gripping means for holding sheets and a long row of rollers for moistening units and inking units which are in connection with the plate cylinder. Since these are well-known, they are not shown in FIG. 1 which serves as illustration of the structure of the offset unit. These rollers, however, appear in FIG. 2.

Figure 2:
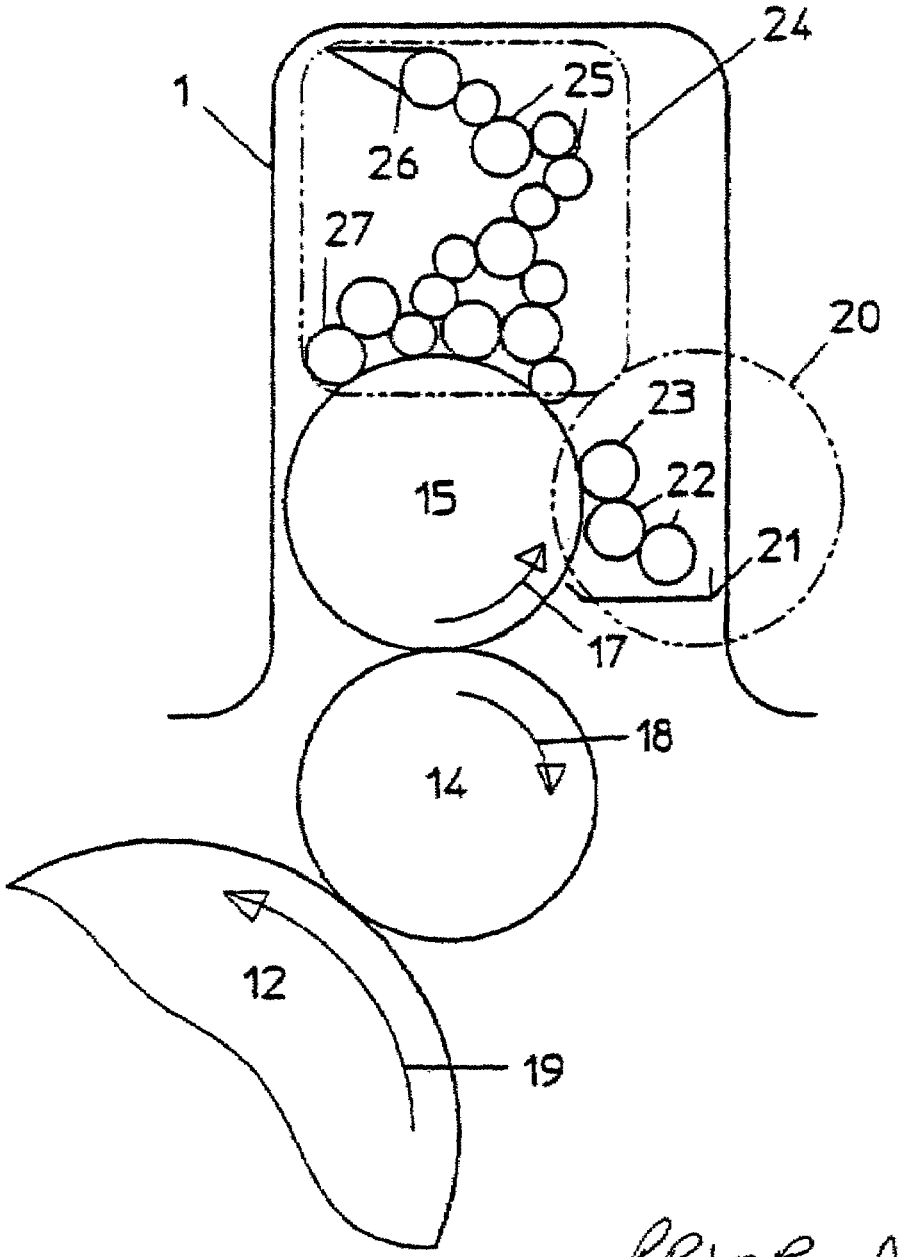
FIG. 2 shows a partial view for illustrating a known printing unit comprising a moistening unit and an inking unit.

FIG. 2 shows a printing unit 1 comprising an impression cylinder 12, a blanket cylinder 14 and a plate cylinder 15. These cylinders are rotating according to the arrows 17,18, 19. A moistening unit comprises a container 21 for water. From the water container 21 the water is led via a system of rollers 22 to the last contact roller 23 which is in contact with the plate cylinder 15. The printing unit 1 furthermore comprises an inking unit 24 comprising a number of rollers 25 transferring ink from an ink container 26 to contact rollers 27 which apply the ink on a soft printing plate (not shown) situated on the plate cylinder 15. The printing plate located on the plate cylinder will thus be imparted ink in the areas where water has not been applied from the moistening unit 20. The printing plate is usually an etched metal plate.

As a coating unit is built up in principle as the moistening unit 20, FIG. 2 may also be said to illustrate a coating unit. The coating will thus be conveyed up from the container 21 containing coating and transferred via rollers 22 to the last contact roller 23 which is also called the forming roller. However, a coating unit will preferably be mounted on the blanket cylinder 14 for avoiding undesired dirtying.

The embodiment shown have some environmental and printing disadvantages. Instead of using the existing moistening unit, the printing unit in FIG. 2 may be modified as illustrated in FIG. 3.

Figure 3:
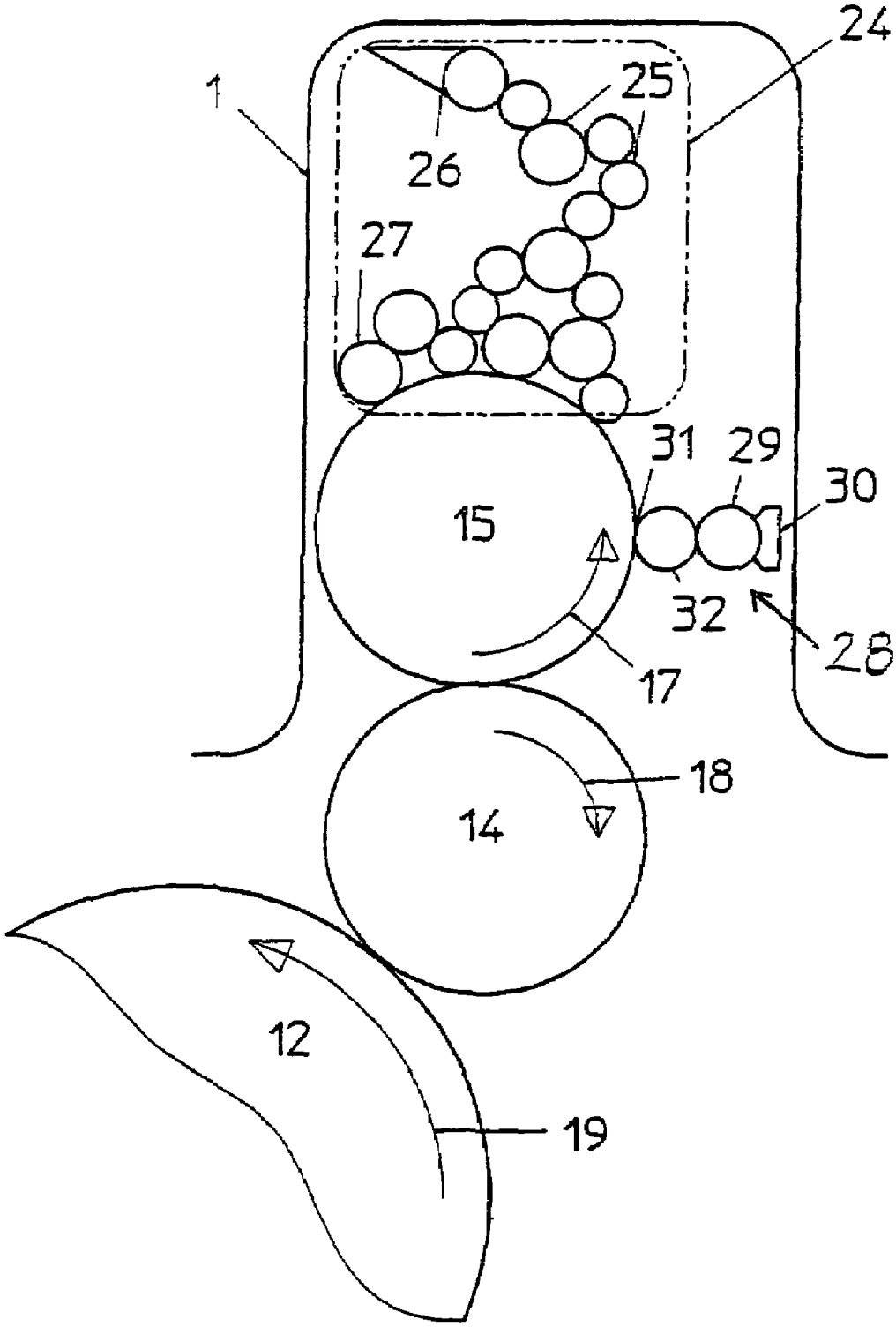
FIG. 3 shows a view corresponding to FIG. 2 for illustrating an embodiment of a printing unit according to the above International patent application.

In FIG. 3 the contact roller 23 is substituted by a unit 28 comprising a doctor blade system 30 and a screen roller 29, preferably an Anilox roller of the kind also used for flexographic printing. The screen roller 29 may be mounted directly in the existing suspension. Between the screen roller 29 and the plate cylinder 15 there is mounted a soft roller 32, preferably a rubber roller. The unit 28 may, even by great peripheral speeds, ensure a constant and uniform amount of water and/or coating transferred to the plate cylinder 15. If the unit 28 is desired to be used for coating, the rollers 27 of the inking unit are brought out of contact with the plate cylinder 15. If the unit 28 is used for water application, the inking unit 24 is kept in engagement with the plate cylinder 15.

The embodiment shown in FIG. 3 may be changed when it is only used for coating. Thus the hard screen roller 29 may be used directly without a soft roller for coating. This will, however, necessitate the use of a rubber blanket on the plate cylinder 15.

The printing unit shown will be very simple and easy to maintain. At the same time, the system is easy to replace depending on whether the printing unit is desired to be used for one or the other purpose. Thus it will be possible, according to wish, to use the existing moistening unit concurrently with the unit 28 according to the invention.

When the unit 28 is used for water application, it will be easy to adjust the water amount in a simple way. Such an adjustment is difficult in traditional moistening units where the rollers are running synchronously with the plate cylinder 15. The rubber roller 32 may be provided with its own motor which is driven independently of the plate cylinder. This creates possibility of a differentiated periphery speed and thereby possibility of stemming up of greater or lesser amount of water in the wedge-shaped interspace 31 formed between the rubber roller 32 and the plate cylinder 15.

Figure 4:
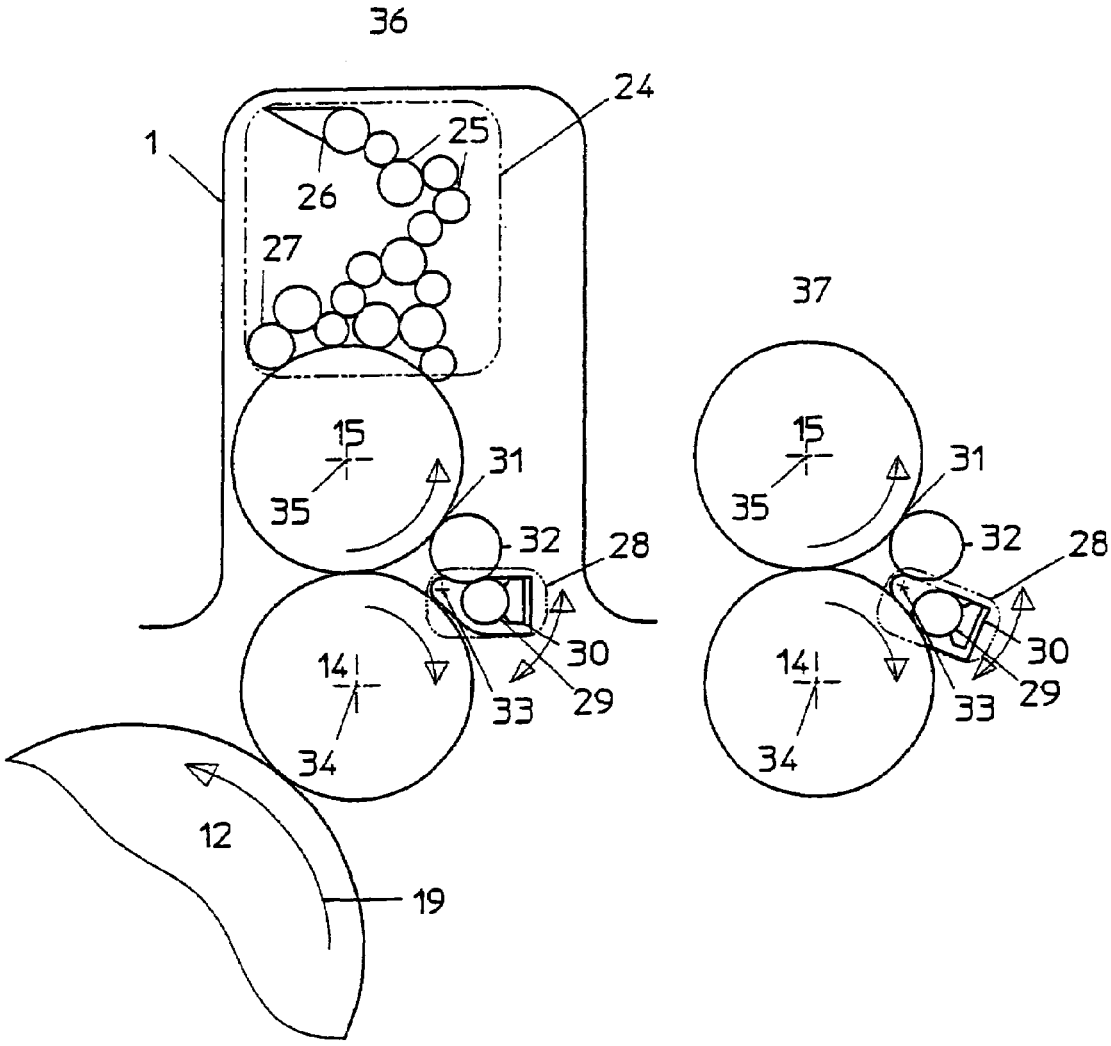
FIG. 4 shows a view corresponding to FIG. 3 for illustrating a first embodiment of a printing unit according to the invention.

In FIG. 4 is shown a first embodiment of a printing unit 1 according to the invention. FIG. 4 differs from the printing unit shown in FIG. 3 by the unit 28 being suspended pivotably about an axis 33 of pivot running in parallel with axes of rotation 34 and 35 for the blanket cylinder 14 and the plate cylinder 15. The unit 28 is shown in a first position 36, where the screen roller 29 is in contact with a soft roller 32 engaging the plate cylinder 15, and a second position 37 where the screen roller 29 is directly engaging the blanket cylinder 14. These two positions are used for water application (position 36) and coating (position 37), respectively.

Figure 5:
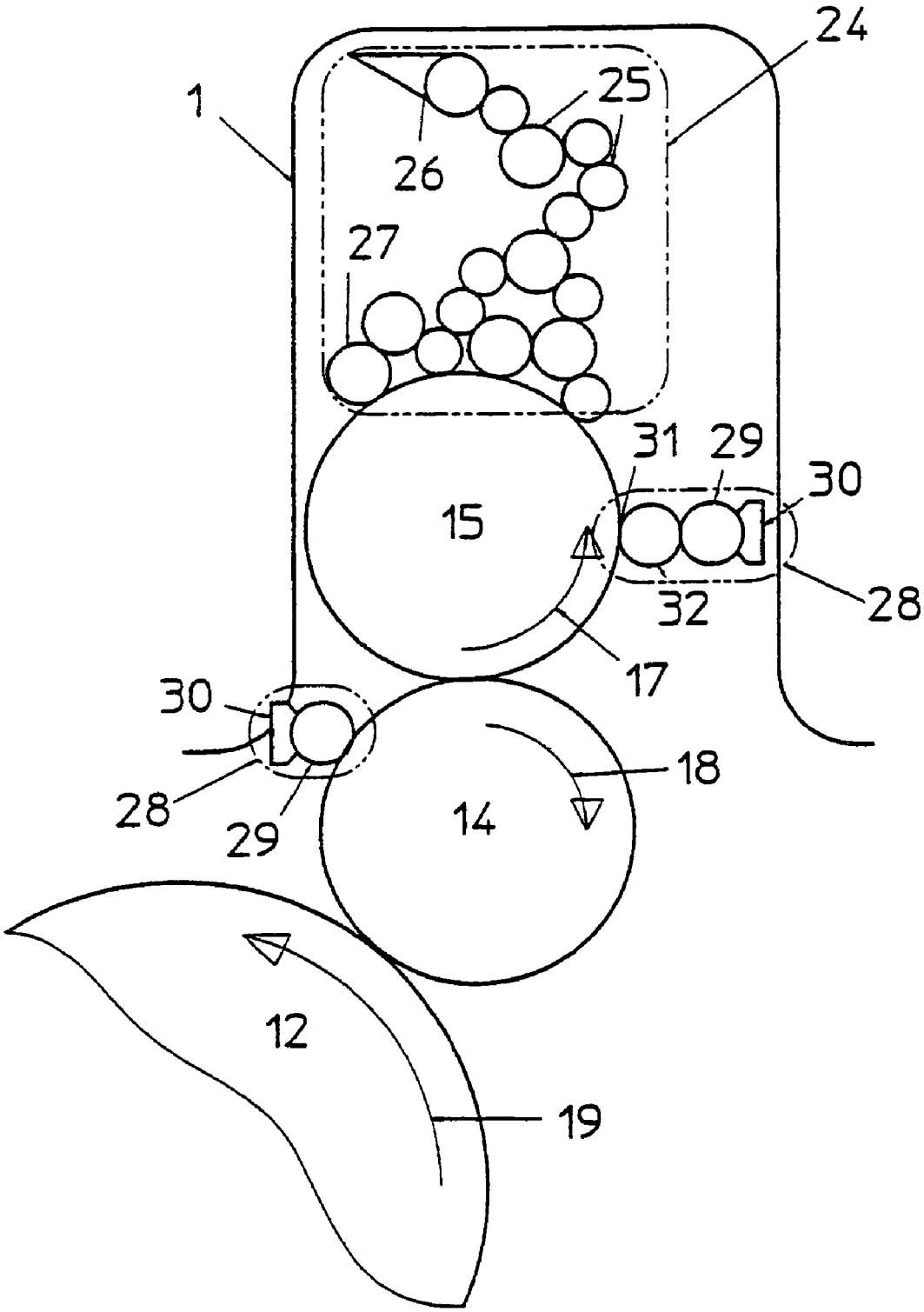
FIG. 5 shows a view for illustrating a further embodiment of a printing unit according to the invention.

FIG. 5 shows a further embodiment of a printing unit according to the invention. In this printing unit there is simultaneous use of two units 28. The unit 28 illustrated to the right in the Figure is used for applying moistening water. The unit 28 shown to the left is used for applying coating. Since it is possible to divide up the doctor blade over its length, it will be possible to apply coating in stripes where the moistening unit does not apply any moisture. Such an effect will not be possible in traditional printing units. The coating unit and the moistening unit as illustrated in FIG. 5 will function according to the same principle as explained above with reference to the preceding Figures. Alternatively, the unit 28 in the left side may be used for transferring coating and flexographic ink. If there is a blanket on the blanket cylinder 14, a completely covering ink will be printed, and if a printing plate is placed on the blanket cylinder 14, a desired flexographically printed image may be established.

What is claimed is:

1. A method for operating a printing unit in an offset machine in which the printing unit comprises a doctor blade system comprising a chamber forming a coating unit for coating and ae a moistening unit for applying water, wherein the doctor blade system and at least one transfer roller interacting with the doctor blade system for transferring coating or water from the doctor blade system are displaced between a first position for transferring water via a plate cylinder to a blanket cylinder and a second position for transferring coating directly to the blanket cylinder wherein the coating and water application unit comprises transfer rollers in the form of a screen roller and a rubber roller for transferring water from the doctor blade system to the plate cylinder and one screen roller for transferring coating directly to the blanket cylinder.

2. A method according to claim 1, wherein the displacement is a pivoting about an axis in parallel with the rotational axis of the plate cylinder and the blanket cylinder.

3. A printing unit for use in a method according to claim 1 in an offset machine, comprising means for coating and means for applying water, and where the coating means and the water application means are constituted by a coating and water application unit comprising a doctor blade system including a chamber and at least one transfer roller for transferring coating or water from the doctor blade system, wherein the coating and water application unit is arranged movably between a first position for bringing said at least one roller in contact with a roller engaging the plate cylinder, and a second position for bringing said at least one roller in direct contact with the blanket cylinder of the printing unit, and wherein the coating and water application unit further comprises said at least one transfer roller in the shape of a screen roller transferring coating directly from the doctor blade system to the blanket cylinder.

4. A printing unit according to claim 3, wherein the coating and water application unit comprising the doctor blade system and the at least one roller is mounted in the offset machine in an exchangeable way with the existing moistening unit of the offset machine.

5. A printing unit according to claim 3, wherein the coating and water application unit is mounted pivotably in relation to the plate cylinder and the blanket cylinder between one of the engagement positions with the plate cylinder and the blanket cylinder.

6. A printing unit according to claim 3, wherein the coating and water application unit is provided with coupling means which are arranged for being connected releasably with coupling means in the frame of the offset machine.

7. A printing unit according to claim 3, wherein the transfer roller is driven by its own motor.

8. A printing unit according to claim 7, wherein said motor is a motor controlled by a line signal from the main machine.

9. A printing unit according to claim 7, wherein said coupling means in the frame is coupling means for a cleaning unit known per se for the plate cylinder.

* * * * *